US005920243A

United States Patent [19]

Ishikawa et al.

[11] Patent Number: 5,920,243

[45] Date of Patent: Jul. 6, 1999

[54] MULTI-LAYER THIN-FILM ELECTRODE, FOR A HIGH-FREQUENCY TRANSMISSION LINE, RESONATOR, AND FILTER

[75] Inventors: Yohei Ishikawa, Kyoto; Seiji Hidaka, Nagaokakyo; Norifumi Matsui, Kyoto; Tomoyuki Ise, Nagaokakyo, all of Japan

[73] Assignee: Murata Manufacturing Co., Ltd., Japan

[21] Appl. No.: 08/868,198

[22] Filed: Jun. 3, 1997

[30] Foreign Application Priority Data

Jun. 3, 1996 [JP] Japan ..... 8-140059

[51] Int. Cl.[6] ..... H01P 1/203; H01P 3/08; H01P 30/06; H01P 7/00

[52] U.S. Cl. ..... 333/204; 333/219; 333/238; 333/243

[58] Field of Search ..... 333/238, 246, 333/236, 243, 219, 204

[56] References Cited

U.S. PATENT DOCUMENTS 2,769,170 10/1956 Clogston ..... 333/243 X 5,770,988 6/1998 Goto et al. ..... 333/238 X

*Primary Examiner*—Benny Lee

*Attorney, Agent, or Firm*—Ostrolenk, Faber, Gerb & Soffen, LLP

[57] ABSTRACT

A multi-layer thin-film electrode comprises thin conductor films and thin dielectric films each being alternately laminated on a dielectric substrate, in which an electro-magnetic field generated in the dielectric substrate and that generated in each of the thin dielectric films have substantially the same phase at a predetermined frequency. According to the multi-layer thin-film electrode of the present invention, adhesive conductor films that more readily form metallic oxide as compared with the thin conductor films are provided between the dielectric substrate and the thin conductor films adjacent thereto and between each of the thin conductor films and the thin dielectric film adjacent thereto, respectively, and an increase in the surface reactance of the thin conductor films caused by the adhesive conductor film formation is canceled by correcting the thickness of each of the thin dielectric films based on the dielectric constant of the thin dielectric film and the dielectric substrate and the thickness of at least one of the adhesive conductor films.

14 Claims, 4 Drawing Sheets

COAXIAL LINE

STRIP LINE

MICROSTRIP LINE

TM010 MODE RESONATOR

TM01 MODE WAVE GUIDE

MULTI-LAYER THIN-FILM ELECTRODE, FOR A HIGH-FREQUENCY TRANSMISSION LINE, RESONATOR, AND FILTER

BACKGROUND OF THE INVENTION

1. Field of the Invention

The present invention relates to a multi-layer thin-film electrode used in a high-frequency band, such as microwave, sub-millimeter wave, or millimeter wavebands.

2. Description of the Related Art

Recently, electronic parts have become smaller in size. The size of high-frequency devices used in a high-frequency band, such as microwave, sub-millimeter wave, or millimeter wavebands is also reduced by employing materials having a high dielectric constant. However, when a smaller size is achieved by increasing the dielectric constant, the energy loss is disadvantageously raised in inverse proportion to the cubic root of volume. The energy loss of high-frequency devices can be roughly classified into a conductor loss due to skin effect and a dielectric loss due to dielectric materials. Recently, dielectric materials having a high dielectric constant with a low dielectric loss have been put to practical use. Therefore, the conductor loss is more dominant than the dielectric loss in determining unloaded-Q of a circuit.

Under the above circumstances, in a laid-open international application NO. WO 95/06336, the inventors of the present invention proposed a multi-layer thin-film electrode which can reduce the conductor loss in high-frequency bands. FIG. 4 is a perspective view of a 1/2 λ line resonator composed of the conventional multi-layer thin-film electrode 200 indicated in the international application. The multi-layer thin-film electrode 200 is prepared as follows: a grounded conductor 11 is formed on the entire rear surface of a dielectric substrate 10; a band-shape thin conductor film 3*a* whose length is λg/2 (λg indicates wavelength in waveguide) in the longitudinal direction, is formed on the dielectric substrate 10; and then a thin dielectric film 30*a*-2, a thin conductor film 2*a*, a thin dielectric film 30*a*-1, and a thin conductor film 1*a* are laminated on the thin conductor film 3*a* in the given order to complete the multi-layer thin-film electrode 200 on the dielectric substrate 10.

As above-mentioned, a microstrip line (hereinafter referred to as "main transmission line") LN 10*a* for TEM mode is formed by the thin conductor film 3*a*, the grounded conductor 11, and the dielectric substrate 10 sandwiched between the thin conductor film 3*a* and the grounded conductor 11. Meanwhile, above the main transmission line LN10*a*, a sub transmission line for TEM mode is formed by sandwiching the thin dielectric film 30*a*-2 between one pair of thin conductor films 2*a* and 3*a*, and another sub transmission line for TEM mode is formed by sandwiching the thin dielectric film 30*a*-1 between one pair of thin conductor films 1*a* and 2*a*. According to a method disclosed in WO 95/06336, the conventional multi-layer thin-film electrode 200 is set up as follows:

(a) the thickness and the dielectric constants $\in_s$ of the thin dielectric film 30*a*-1 and those of the thin dielectric film 30*a*-2 are set to predetermined values, respectively, so that the TEM wave transmitted through the main transmission line LN10*a* and the sub transmission lines, respectively, have substantially the same phase velocity; and (b) the thickness of the thin conductor film 2*a* and that of the thin conductor film 3*a* are set to predetermined values, respectively, which values are thinner than the skin depth at an operation frequency so that the electro-magnetic field of the main transmission line LN 10*a* and that of the sub transmission line adjacent thereto are coupled and the electro-magnetic fields of the sub transmission lines adjacent to each other are coupled.

Thus, the high-frequency energy flowing into the main transmission line LN 10*a* partially flows into the sub transmission lines so that high-frequency current flows through each of the thin conductor films 1*a* to 3*a*. The skin effect in the multi-layer thin-film electrode 200 is thereby largely suppressed at high frequencies.

A 1/2 λ line resonator as shown in FIG. 4 can operate as a band-pass filter when connected to an external circuit via a conductor 12 for an input terminal and a conductor 13 for an output terminal, which conductors 12 and 13 are formed on the dielectric substrate 10.

However, such conventional multi-layer thin-film electrodes disadvantageously have low adhesive strength between the dielectric substrate and a thin conductor film adjacent thereto and between each thin dielectric film and a thin conductor film adjacent thereto, resulting in reduced reliability. In addition, when interlayer adhesive conductive films are provided for improving the adhesive strength between the thin dielectric substrate and a thin conductor film adjacent thereto and between each thin dielectric film and a thin conductor film adjacent thereto, skin effect cannot be satisfactorily suppressed.

SUMMARY OF THE INVENTION

Accordingly, it is an object of the present invention to provide a multi-layer thin-film electrode which exhibits sufficient suppression of skin effect, and which has excellent reliability with higher adhesive strength between the dielectric substrate and a thin conductor film adjacent thereto and between each thin dielectric film and a thin conductor film adjacent thereto as compared with that of conventional multi-layer thin-film electrodes.

A multi-layer thin-film electrode of the present invention has thin dielectric films and thin conductor films, each of which is alternately laminated with an adhesive conductor film therebetween. The thickness of each layer is set so that sufficient suppression of skin effect can be maintained.

In other words, a multi-layer thin-film electrode of the present invention is characterized in that adhesive conductor films which more readily form metallic oxide as compared with the thin conductor films are provided between the dielectric substrate and the thin conductor films adjacent thereto and between each of the thin conductor films and the thin dielectric film adjacent thereto, respectively. Moreover, an increase in the surface reactance of the thin conductor films caused by the insertion of the adhesive conductor films, is canceled by correcting the thickness of each of the thin dielectric films based on the dielectric constants of the thin dielectric film and the dielectric substrate and the thickness of the adhesive conductor film adjacent to the thin dielectric film.

In accordance with the above structure, an electromagnetic field transmitted in the dielectric substrate and that transmitted in each thin dielectric film have substantially the same phase at a predetermined frequency. That is, when transmission lines are formed using the above multi-layer thin-film electrode, the progressive waves transmitted through the inside of the dielectric substrate and the inside of the thin dielectric films, respectively, have substantially the same phase velocity; and when a resonator is formed using the above multi-layer thin-film electrode, the electromagnetic fields transmitted in the dielectric substrate and thin dielectric conductor films, respectively, oscillate at substantially the same phase.

According to the present invention, for improving the interlayer adhesive strength, adhesive conductor films are preferably comprised of at least one metal selected from the group comprising Zr, Hf, Ti, Ta, Nb, V, and Cr, which metals have a high standard enthalpy of oxide formation. In this case, thickness of each thin dielectric film is preferably corrected based on the thickness correction Δxs shown below.

$$\Delta xs=\{(\in_m/\in_s)-1\}^{-1}\cdot\Delta s$$

wherein $\in_m$ is the dielectric constant of the dielectric substrate 10, $\in_s$ the dielectric constant of each thin dielectric film, and Δs is the thickness of the adhesive conductor film adjacent to each thin dielectric film.

A transmission line of the present invention has a multi-layer thin-film electrode of the present invention formed in a predetermined shape on at least one side of a dielectric substrate.

A high-frequency resonator of the present invention has a multi-layer thin-film electrode of the present invention formed in a predetermined shape on at least one side of a dielectric substrate.

A high-frequency filter of the present invention comprises: a plurality of high-frequency resonators of the present invention, each pair of the high-frequency resonators positioned adjacent to each other being electro-magnetically coupled; an input terminal for inputting signals to the high-frequency resonators; and an output terminal for outputting signals from the high-frequency resonators.

Other features and advantages of the present invention will become apparent from the following description of the invention which refers to the accompanying drawings.

BRIEF DESCRIPTION OF THE DRAWINGS

FIG. 3(*a*) shows a microstrip line,

FIG. 3(*b*) shows a stripline;

FIG. 3(*c*) shows coaxial line one;

FIG. 3(*d*) shows a mode wave guide; and

FIG. 3(*e*) shows a mode resonator; and

DETAILED DESCRIPTION OF EMBODIMENTS OF THE INVENTION

The present invention will be better understood from the following description of the preferred embodiments taken in conjunction with the accompanying drawings.

Figure 1:
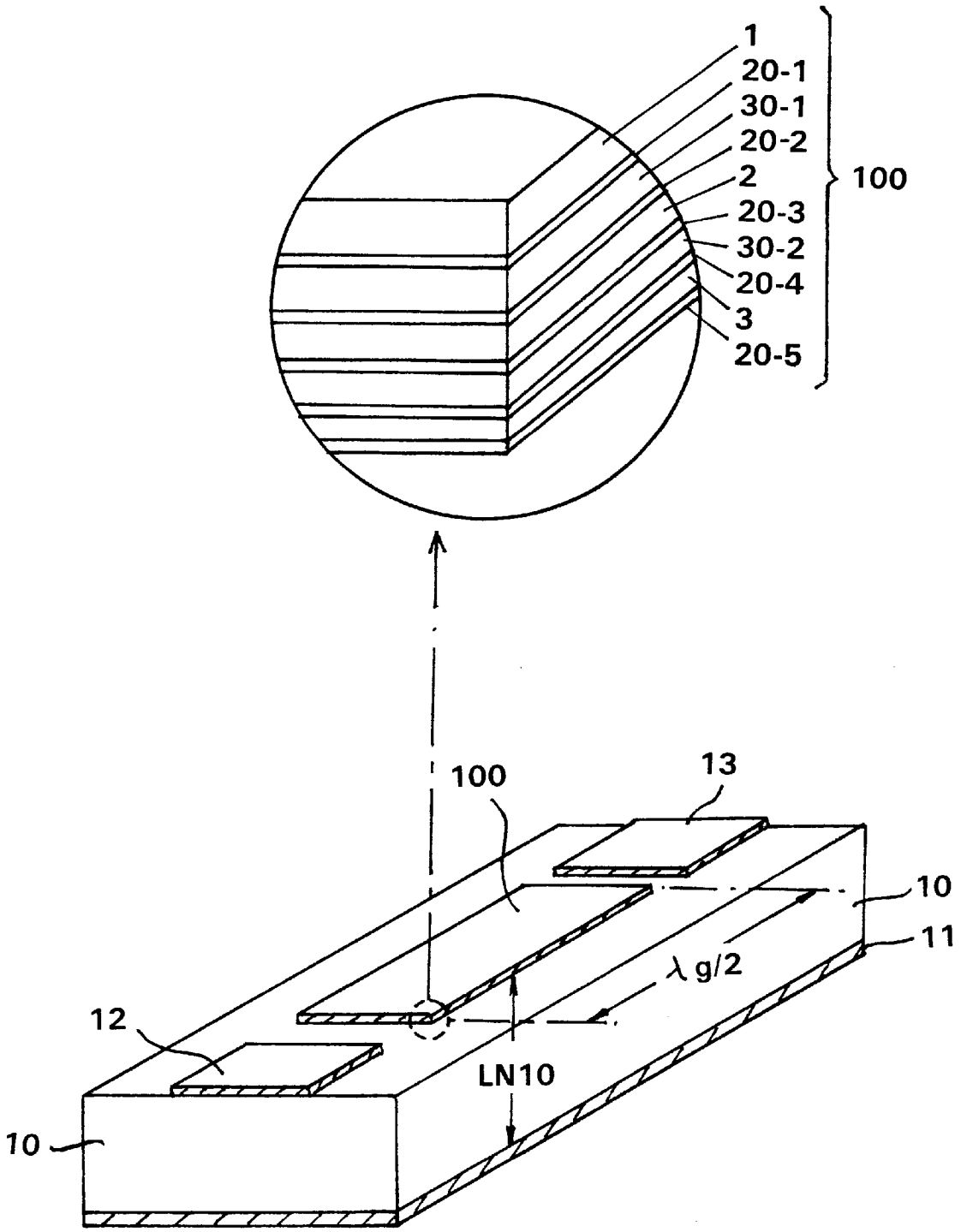
FIG. 1 is a perspective diagram of a 1/2 λ line resonator using a multi-layer thin-film electrode of the present invention.

FIG. 1 is a perspective diagram of a 1/2 λ line resonator of one embodiment incorporated in the present invention. The 1/2 λ line resonator is characterized in that a multi-layer thin-film electrode 100 of the present invention, in which adhesion conductor films are provided between a dielectric substrate 10 and a thin conductor film adjacent thereto and between each thin conductor film and a thin dielectric film adjacent thereto, respectively, is employed instead of the multi-layer thin-film electrode 200 used in conventional thin-film multi-layer electrodes.

According to the 1/2 λ line resonator of the present invention, a grounded conductor 11 is formed on the entire reverse surface of a dielectric substrate 10 and a ribbon-shape thin conductor film 3 having a length of λg/2 long in the longitudinal direction is formed on the dielectric substrate 10 with an adhesive conductor film 20-5 therebetween. An adhesive conductor film 20-4, a thin dielectric film 30-2, an adhesive conductor film 20-3, a thin conductor film 2, an adhesive conductor film 20-2, a thin dielectric film 30-1, an adhesive conductor film 20-1, and a thin conductor film 1 are then laminated on the thin conductor film 3 in the given order. A multi-layer thin-film electrode 100 is thereby produced which is composed of an adhesive conductor film 20-5, a thin conductor film 3, an adhesive conductor film 20-4, a thin dielectric film 30-2, an adhesive conductor film 20-3, a thin conductor film 2, an adhesive conductor film 20-2, a thin dielectric film 30-1, an adhesive conductor film 20-1, and a thin conductor film 1 laminated in that order on the dielectric substrate 10. Input conductor 12 and output conductor 13 respectively couple electromagnetic energy to and from conductor 100.

Metals readily forming a compound with oxygen are used as materials for an adhesive conductor film. The more readily a metal forms a compound with oxygen, the more the adhesive strength between the dielectric substrate and a thin conductor film adjacent thereto and between each thin conductor film and a thin dielectric film adjacent thereto is improved. In other words, metals having a high standard enthalpy of oxide formation as shown in Table 1 are preferable.

TABLE 1

| metal | standard enthalpy of formation (kJ/mol) |
|---|---|
| Zr | −370 |
| Hf | −370 |
| Ti | −320 |
| Ta | −310 |
| Nb | −290 |
| V | −270 |
| Cr | −220 |

The dielectric substrate 10 has a relatively high dielectric constant and a small dielectric loss and is preferably formed from single-crystallized alumina such as sapphire or ceramics (e.g., (Zr, Sn)$TiO_4$). The thin dielectric films 30-1 and 30-2 are preferably made of $SiO_2$, $Ta_2O_5$, or TaSiO, each of which has a small dielectric loss and is readily formed into thin-films. The grounded conductor 11 and thin conductor films 1 to 3 are preferably made from highly conductive metals such as Cu, Al, Au, and Ag.

In the 1/2 λ line resonator having the above-mentioned structure, a main transmission line LN 10 according to a TEM mode is formed by the thin conductor film 3, the grounded conductor 11, and the dielectric substrate 10 sandwiched between the thin conductor film 3 and the grounded conductor 11 with an adhesive conductor film 20-5 provided between the thin conductor film 3 and the dielectric substrate 10. Meanwhile, above the main transmission line LN10*a*, a sub transmission line according to a TEM mode is formed by sandwiching the thin dielectric film 30-2 between one pair of thin conductor films 2 and 3 such that the adhesive conductor film 20-3 is provided between the thin conductor film 2 and the thin dielectric film 30-2 and the adhesive conductor film 20-4 is provided between the thin dielectric film 30-2 and the thin conductor film 3, and another sub transmission line according to a TEM mode is formed by sandwiching the thin dielectric film 30-1 between one pair of thin conductor films 1 and 2 such that the adhesive conductor film 20-1 is provided between the thin conductor film 1 and the thin dielectric film 30-1 and the adhesive conductor film 20-2 is provided between the thin dielectric film 30-1 and the thin conductor film 2.

In particular, the multi-layer thin-film electrode 100 is set up as follows:

(a) using a method as mentioned below, the thickness of the thin dielectric film 30-1 and that of the thin dielectric film 30-2 are set to values obtained by correcting the thickness of the thin dielectric film 30*a*-1 and that of the thin dielectric film 30*a*-2 in the conventional multi-layer thin-film electrode 200, and thereby the TEM waves transmitted through the main transmission line LN10 and the sub transmission lines, respectively, have substantially the same phase velocity; and (b) the thickness of the thin conductor film 2 and that of the thin conductor film 3 are set to predetermined values, respectively, that are thinner than the skin depth at an operation frequency so that the electro-magnetic field of the main transmission line LN 10 and that of the sub transmission line adjacent thereto are coupled, and the electro-magnetic fields of the sub transmission lines adjacent to each other are also coupled.

The skin effect at high frequencies is thereby largely suppressed in the multi-layer thin-film electrode 100 having the adhesive conductor films 20-1 to 20-5. Moreover, in this embodiment, the thin conductor-films 1, 2, and 3, the thin dielectric films 30-1 and 30-2, and the adhesive conductor films 20-1 to 20-5 are prepared such that the more upper layer a film is, the thicker it is formed using the method described in Japanese Patent Application No. 6-310900 so as to more effectively suppress the skin effect as compared with the conventional multi-layer thin-film electrode 200.

A method of correcting the thickness of each thin dielectric film will be explained below.

When adhesive conductor films are provided between a dielectric substrate and a thin conductor film adjacent thereto and between each thin conductor film and a thin dielectric film adjacent thereto, respectively, for improving the adhesive strength while setting the thin dielectric films to have the same thickness as that of the thin dielectric films used in the conventional multi-layer thin-film electrode 200, the suppression (i.e., Q elevation effect) of the skin effect deteriorates. From investigation by the inventors of the present invention, it was revealed that the above phenomenon was due to an increase in surface reactance of a thin conductor film in contact with an adhesive conductor film.

Therefore, practical methods have been investigated for canceling the increase ΔX in surface reactance of a thin conductor film, which increase is due to the adhesive conductive film formation. As a result, it was found that the increase ΔX in surface reactance could be canceled when a thin dielectric film in contact with the adhesive conductor film whose opposite side was in contact with the thin conductor film was thickened to a predetermined thickness. In other words, when an adhesive conductor film having a film thickness Δs is formed, the increase ΔX in surface reactance of a thin conductor film in contact with the adhesive conductor film is shown by the following equation 1:

$$\Delta X=\Delta s/\delta_0 \qquad \text{Equation 1}$$

wherein $\delta_0$ is the skin depth of a thin conductor film in contact with the adhesive conductor film and Δs is the film thickness. It was found that the thickness correction Δxs for a thin dielectric film required for canceling the increase ΔX of equation 1 could approximately be shown by the following equation 2:

$$\Delta xs=\{(\in_m/\in_s)-1\}^{-1}\cdot\Delta s \qquad \text{Equation 2}$$

wherein $\in_m$ is the dielectric constant of the dielectric substrate 10 and $\in_s$ is the dielectric constant of the thin dielectric film. When thin conductor films are formed from highly conductive metals such as Cu (conductivity $\sigma_{cu}\approx 53\times 10^6$), Ag (conductivity $\sigma_{Ag}\approx 61\times 10^6$), Au (conductivity $\sigma_{Au}\approx 45\times 10^6$), and Al (conductivity $\sigma_{Al}\approx 37\times 10^6$), the approximate equation 2 holds good in a range of about $10^3<\sigma_S<2\times 10^6$ to $5\times 10^6$ S/m (i.e., the conductivity $\sigma_S$ is not less that $10^3$ and not more than one tenth of the conductivity of thin conductor film). As is shown in the above, by setting the thickness of a thin dielectric film Δxs larger, which Δxs satisfies the equation 2, the multi-layer thin-film electrode 100 having adhesive conductor films can operate similar to the conventional multi-layer thin-film electrode 200, resulting in suppression of the skin effect similar to the conventional multi-layer thin-film electrode 200. The thickness correction Δxs obtained from the equation 2 is applied to cases of forming one adhesive conductor film on the upper or lower side of a thin dielectric film. When adhesive conductor films are provided on both sides of a thin dielectric film, respectively, the correction amount of the thin dielectric film is 2×Δxs.

Figure 2:
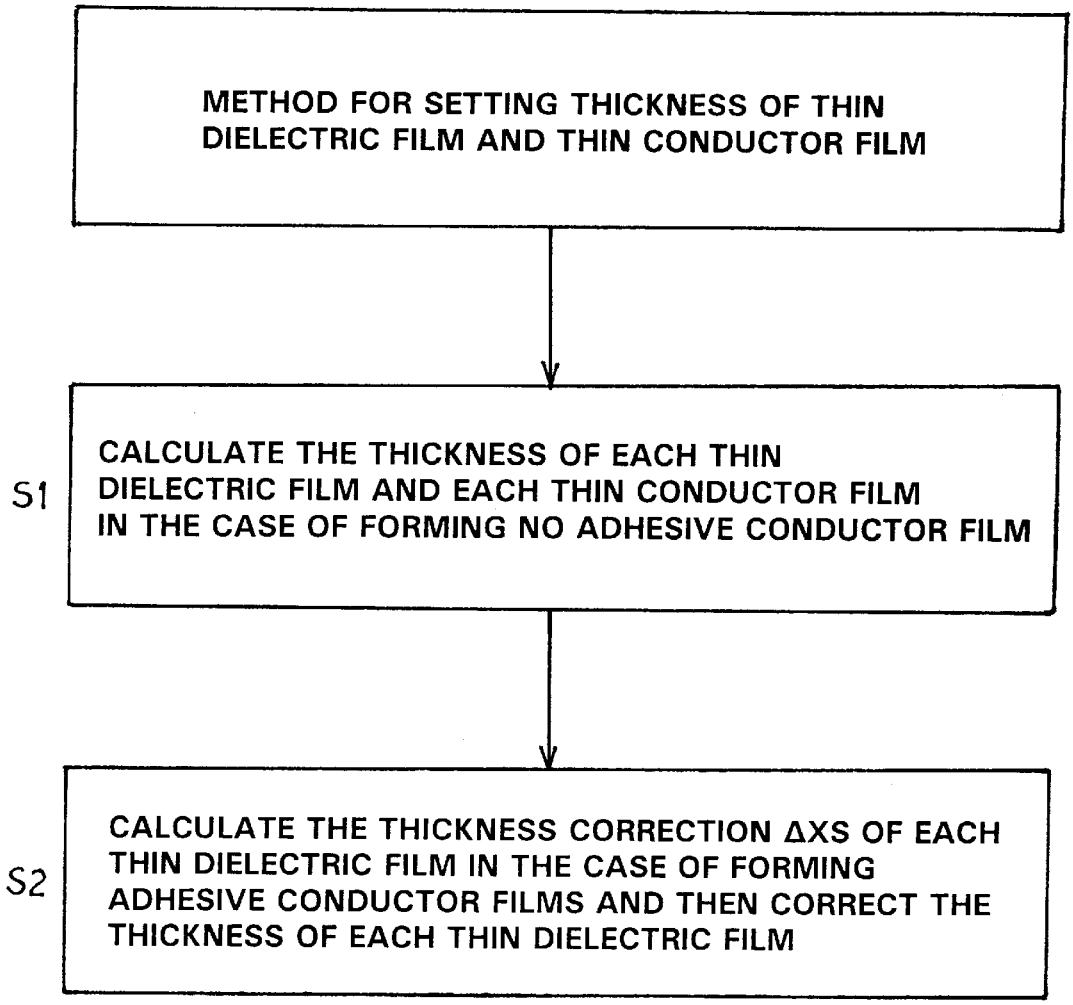
FIG. 2 is a flow chart showing a method for setting the thickness of each thin conductor film and that of each thin dielectric film according to the present invention.

FIG. 2 is a flow chart showing a method for setting film-thickness according to the present invention including the above-mentioned correction method. As is shown in the flow chart, in Step S1, the thickness and dielectric constant $\in_s$ of each thin dielectric film and the thickness of each thin conductor film are set by a conventional method which is employed for setting the thickness of each thin conductor film and that of each thin dielectric film in the case of forming no adhesive conductor film. In step S2, the thickness correction Δxs for each thin dielectric film is calculated using equation 2 based on the dielectric constant $\in_s$ of the thin dielectric film, the dielectric constant $\in_m$ of the dielectric substrate, and the thickness of the adhesive conductor film in contact with the thin dielectric film. The thickness of each thin dielectric film set in Step S1 is corrected by adding the resulting thickness correction. The thickness of each thin conductor film set in Step S1 is used as the setting value without correction and that of each thin dielectric film obtained by correction of Step S2 is used as the setting value. Therefore, the thickness of each thin conductor film and that of each thin dielectric film can be set according to relatively simple steps.

As a result, a 1/2 λ line resonator having a high Q value at no-load can be achieved by forming the resonator using the multi-layer thin-film electrode 100, the grounded conductor 11, and the dielectric substrate 10 provided between the multi-layer thin-film electrode 100 and the grounded conductor 11. Furthermore, a band-pass filter using the 1/2 λ line resonator can be obtained as follows with reference to FIG. 1: a conductor 12 for an input terminal is formed such that the conductor 12 and one longitudinal end of the multi-layer thin-film electrode 100 are positioned with a predetermined distance therebetween and electromagnetically coupled with each other; and a conductor 13 for an output terminal is formed such that the conductor 13 and the other longitudinal end of the multi-layer thin-film electrode 100 are positioned with a predetermined distance therebetween and electro-magnetically coupled with each other. In this embodiment, the conductor 12 for an input terminal and one end of the thin conductor film 3 are capacitively coupled, as well as the conductor 13 for an output terminal and the other end of the thin conductor film 3.

Since multi-layer thin-film electrodes having adhesive conductor films can achieve higher interlayer adhesive strength, mechanical strength and resistance to environmental changes are improved. The range of applicable processes after film-forming a multi-layer thin-film electrode on a ceramic substrate thereby increases. The multi-layer thin-film electrode can endure mechanical processing, for example, the substrate can be cut by a dicer together with the multi-layer thin-film electrode, and the substrate can be polished together with the multi-layer thin-film electrode. Therefore, the substrate can be subjected to various processing steps after forming the multi-layer thin-film electrode on the substrate. In addition, the multi-layer thin-film electrode can endure severe environmental conditions in which the temperature varies from ultra-low to high, resulting in a wider temperature range for device operation. Therefore, a multi-layer thin-film electrode of the present invention can be applied to not only the above-mentioned resonator and filter but also to various types of resonators and filters. Resonators and filters having excellent resistance to the environment can also be provided according to the multi-layer thin-film electrode of the present invention.

EXAMPLES

Examples of the present invention will be described below.

In the following examples, the Q elevation rate was compared between a case of correcting the thickness of thin dielectric films and a case of not correcting the thickness of thin dielectric film. Parameters used in the following examples were set as follows:

(1) operation frequency of multi-layer thin-film electrode 2.6 GHz;

(2) relative dielectric constant of dielectric substrate ((Zr, Sn) $TiO_4$) $\in_m$ 38.0;

(3) relative dielectric constant of thin dielectric $SiO_2$) $\in_s$ 4.1;

(4) conductivity of thin conductor film (Cu) $\sigma_1$ $50\times10^6$ S/m;

(5) conductivity of adhesive conductor film (Ti)$\sigma_2$ $1\times10^6$ S/m.

Further, each of the following examples shows a multi-layer thin-film electrode in which a top electrodes is thicker than other lower thin electrodes inside the layer and the lower electrodes have same thickness. Also, the thickness of thin dielectric films are the same.

Ideally, as indicated in our Japanese application No. 6-310900, the thickness of thin dielectric films gradually decreases from the top to the bottom of the layer so that the thickness of the lowest thin dielectric film is the smallest.

However, to establish practical mechanical strength of the layer, the lower dielectric layers may be thicker than their ideal thickness for providing maximum suppression of the skin effect.

Even if, the multi-layer thin-film electrode has a structure indicated in any one of the following examples, sufficient suppression of skin effect can be achieved. Acceptable range of the thickness of the dielectric thin film is also described in the Japanese application.

Example 1

First, results obtained from evaluation of a conventional multi-layer thin-film electrode will be shown for comparison, and second, those of Example 1 will be described. Table 2 shows the results obtained from evaluation of a conventional multi-layer thin-film electrode which has five thin conductor film layers (hereinafter the number of layers means the number of thin conductor film layers) and which is prepared without forming any adhesive conductive film under the above-mentioned parameter conditions.

TABLE 2

| Setting film-thicknesses and Q elevation rate in conventional multi-layer thin-film electrode (5 layers) | |
|---|---|
| thickness of the thin conductor film 1 | 4.2 μm (top layer) |
| thickness of the other thin conductor films | 0.756 μm |
| thickness of thin dielectric films | 0.0968 μm |
| Q elevation rate | 2.39 times |

In the conventional multi-layer thin-film electrode as shown in Table 2, the Q elevation rate was increased 2.28 fold when 40 nm-thick adhesive conductor films were formed between the dielectric substrate 10 and a thin conductor film adjacent thereto and between each thin conductor film and a thin dielectric film adjacent thereto, respectively, without correction of the thickness of each thin dielectric film. In other words, it was confirmed that the Q elevation rate of a multi-layer thin-film electrode decreased when adhesive conductor films were provided for the multi-layer thin-film electrode without correction of the thickness of each thin dielectric film.

Results of evaluation obtained from a multi-layer thin-film electrode of Example 1 are shown in Table 3, in which multi-layer thin-film electrode 40 nm-thick adhesive conductor films were formed between the dielectric substrate 10 and a thin conductor film adjacent thereto and between each thin conductor film and a thin dielectric film adjacent thereto, respectively, with correction of the thickness of each thin dielectric film.

TABLE 3

| Setting film-thicknesses and Q elevation rate in multi-layer thin-film electrode (5 layers) of Example 1 | |
|---|---|
| thickness of the thin conductor film 1 | 7.0 μm (top layer) |
| thickness of the other thin conductor films | 0.756 μm |
| thickness of thin dielectric films | 0.107 μm |
| Q elevation rate | 2.39 times |

As is apparent from Tables 2 and 3, a Q elevation effect similar to a conventional multi-layer thin-film electrode was obtained by forming a multi-layer thin-film electrode of Example 1 with adhesive conductor films while setting the thickness of each thin conductor film and that of each thin dielectric film according to the foregoing correction method.

Example 2

In Example 2, the Q elevation rate was evaluated on a multi-layer thin-film electrode which has ten layers and which was prepared according to the same parameters as in Example 1. Table 4 shows the setting film-thicknesses and Q elevation rate of a conventional multi-layer thin-film electrode. Table 5 shows the setting film-thicknesses and Q elevation rate of a multi-layer thin-film electrode of Example 2, which multi-layer thin-film electrode was provided with adhesive conductor films and the thickness of each thin dielectric film was corrected to a predetermined thickness.

TABLE 4

| Setting film-thicknesses and Q elevation rate in conventional multi-layer thin-film electrode (10 layers) | |
|---|---|
| thickness of the thin conductor film 1 | 4.2 μm (top layer) |
| thickness of the other thin conductor films | 0.556 μm |
| thickness of thin dielectric films | 0.0686 μm |
| Q elevation rate | 3.33 times |

| Setting film-thicknesses and Q elevation rate in multi-layer thin-film electrode (10 layers) of Example 2 | |
|---|---|
| thickness of the thin conductor film 1 | 4.2 μm (top layer) |
| thickness of the other thin conductor films | 0.556 μm |
| thickness of thin dielectric films | 0.0783 μm |
| Q elevation rate | 3.33 times |

In the conventional multi-layer thin-film electrode as shown in Table 4, the Q elevation rate was 2.55 times when 40 nm-thick adhesive conductor films were formed between the dielectric substrate 10 and a thin conductor film adjacent thereto and between each thin conductor film and a thin dielectric film adjacent thereto, respectively, without correction of the thickness of each thin dielectric film. As is apparent from Tables 4 and 5, even when the multi-layer thin-film electrode of Example 2 has ten layers, a similar Q elevation effect to a conventional multi-layer thin-film electrode was obtained by forming a multi-layer thin-film electrode with adhesive conductor films while setting the thickness of each thin conductor film and that of each thin dielectric film according to the foregoing correction method.

Modification of multi-layer thin-film electrode of the present invention

Although the multi-layer thin-film electrode 100 was used for a 1/2 λ line resonator in the above examples, it is applicable to other transmission lines and resonators shown below.

Figure 3C:
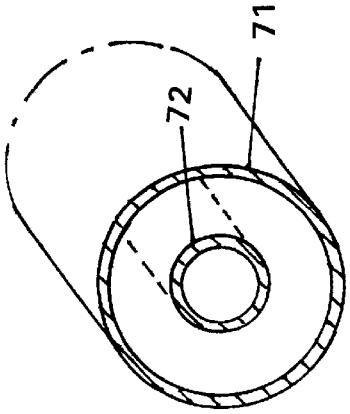
FIG. 3*a* to FIG. 3*e* show modifications using multi-layer thin-film electrodes of the present invention specifically.
Figure 3B:
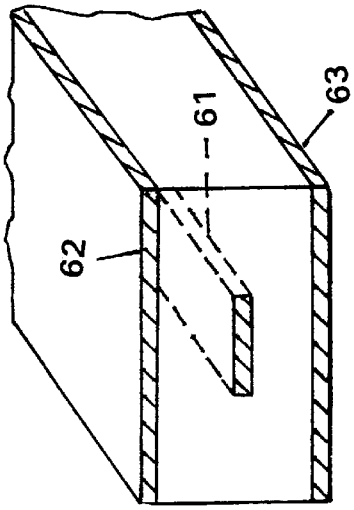
Figure 3A:
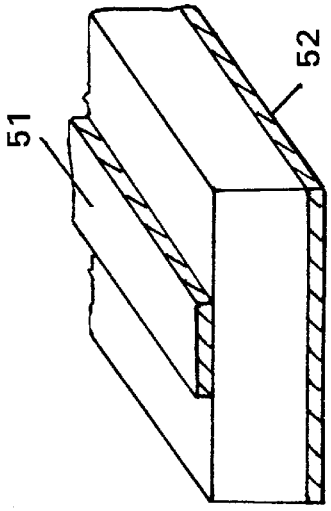

FIG. 3*a* is a perspective view of a microstrip line employing multi-layer thin-film electrodes of the present invention. The multi-layer thin-film electrodes are used for a strip conductor 51 and a grounded conductor 52, or may be used for either the strip conductor 51 or the grounded conductor 52.

FIG. 3*b* is a perspective view of a tri-plate type strip line employing multi-layer thin-film electrodes of the present invention. The multi-layer thin-film electrodes are used for a strip conductor 61 and grounded conductors 62 and 63, or may be used for only one of the strip conductor 61 or at least one of the grounded conductors 62 and 63.

FIG. 3*c* is a perspective view of a coaxial line employing multi-layer thin-film electrodes of the present invention. The multi-layer thin-film electrodes are used for a central conductor 71 and a grounded conductor 72, or may be used for either the central conductor 71 or the grounded conductor 72.

Figure 3E:
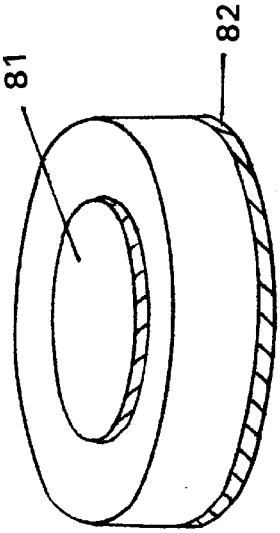
Figure 3D:
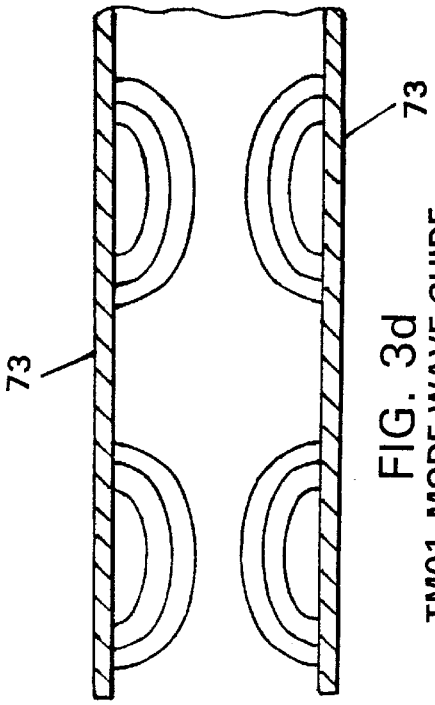
Figure 4:
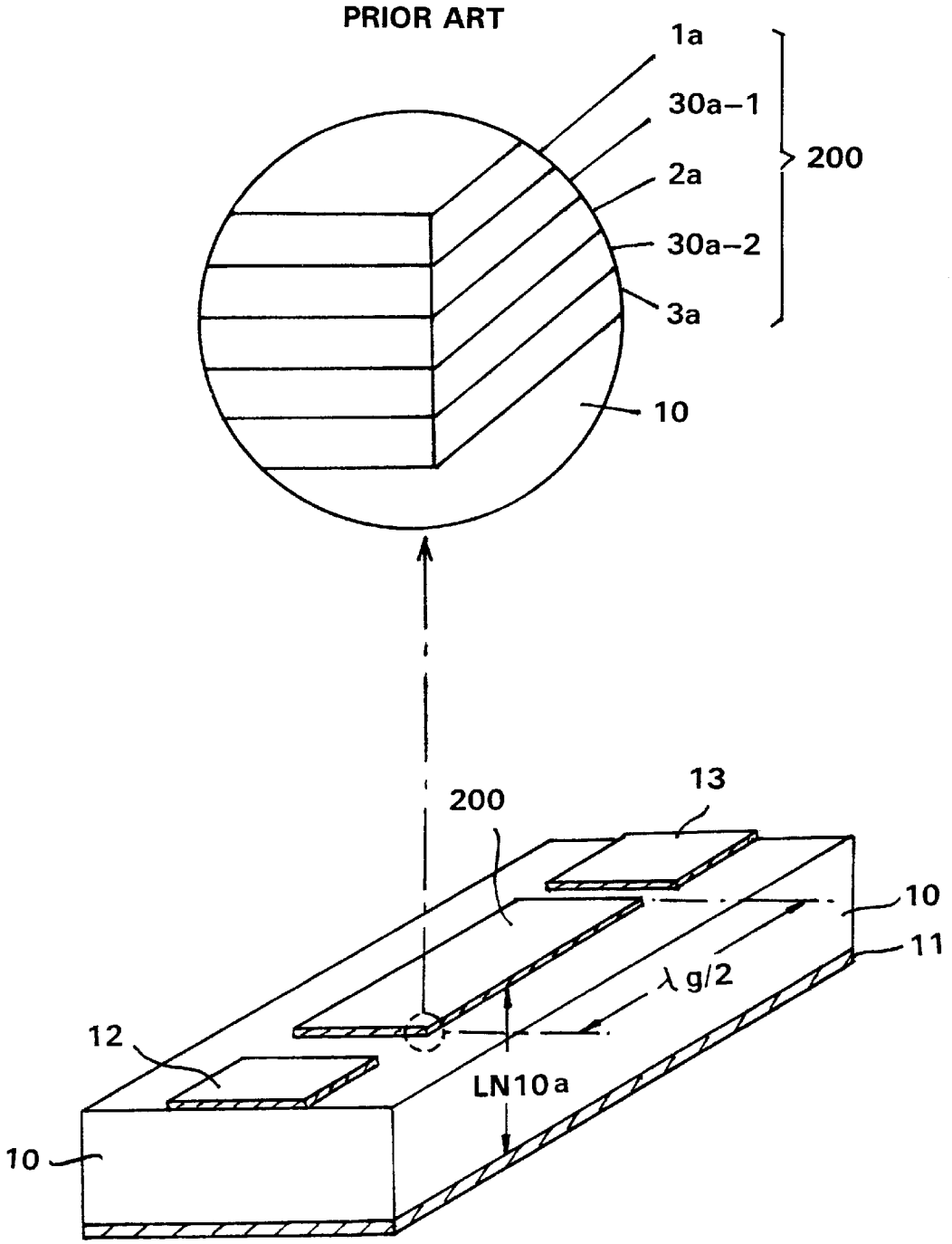
FIG. 4 PRIOR ART
FIG. 4 is a perspective diagram of a 1/2 λ line resonator using conventional multi-layer thin-film electrode.

FIG. 3*d* is a longitudinal sectional view of a $TM_{01}$ mode circular waveguide employing multi-layer thin-film electrodes 73 of the present invention. The multi-layer thin-film electrodes 73 are used as outer-surface electrodes of the circular waveguide.

FIG. 3*e* is a perspective view of a $TM_{010}$ mode resonator employing multi-layer thin-film electrodes of the present invention. The multi-layer thin-film electrodes are used for a patch conductor 81 and a grounded conductor 82 of the resonator, or may be used for either the patch conductor 81 or the grounded conductor 82.

In addition, although not shown in FIGS. 3(*a*) to 3(*e*) the multi-layer thin-film electrode can be used for suspended lines, coplanar lines, slot lines, rectangular waveguides, ridge waveguides, circular waveguides, dielectric lines, G lines, image lines, H lines, and the like. Furthermore, a multi-layer thin-film electrode of the present invention can be employed as an electrode for inductors and capacitors in various high-frequency devices performing predetermined high-frequency operation, such as isolators, antennas, and chip coils.

For applying a multi-layer thin-film electrode of the present invention to a transmission line according to a TM mode except for the TEM mode, as is shown in FIG. 3*d*, the thickness and dielectric constant of each thin dielectric film and the thickness of each thin conductor film and that of each adhesive conductor film are set so as to allow the TM mode progressive wave transmitted through the dielectric substrate and those transmitted through the thin dielectric conductor films to have substantially the same phase velocity when the transmission line is used at a predetermined frequency. For applying a multi-layer thin-film electrode of the present invention to a resonator, as shown in FIG. 3*e*, the thickness and dielectric constant of each thin dielectric film and the thickness of each thin conductor film and that of each adhesive conductor film are set so as to allow a steady-wave electro-magnetic field generated in the dielectric substrate and steady-wave electro-magnetic fields generated in the thin dielectric conductor films to have substantially the same oscillation phase when the resonator resonates at a predetermined frequency. As the above, a multi-layer thin-film electrode of the present invention can be applied to various types of high-frequency transmission lines, high-frequency resonators, and high-frequency filters.

As is apparent from the above description, according to the multi-layer thin-film electrode of the present invention, adhesive films are provided between a dielectric substrate and a thin conductor film adjacent thereto and between each thin dielectric film and a thin conductor film adjacent thereto, thus higher interlayer adhesive strength can be achieved, resulting in a reliable multi-layer thin-film electrode. Moreover, the conductor loss is reduced such that an increase in the surface reactance of each thin conductor film caused by the adhesive conductor film formation is reduced by correcting the film-thickness.

In addition, the above-mentioned adhesive strength can be further increased by using at least one metal selected from the group consisting of Zr, Hf, Ti, Ta, Nb, V, and Cr for the adhesive conductor films. In this case, the conductor loss can more effectively be reduced by correcting the thickness of each thin dielectric film according to the following equation:

$$\Delta xs=\{(\in_m/\in_s)-1\}^{-1}\cdot\Delta s$$

A transmission line of the present invention can decrease the transmission loss because it employs a multi-layer thin-film electrode of the present invention which can reduce the conductor loss at an operation frequency.

A resonator of the present invention can decrease the Q value at no-load because it employs a multi-layer thin-film electrode of the present invention which has a reduced conductor loss at an oscillation frequency.

A high-frequency filter of the present invention can decrease the pass-band loss because it employs a resonator of the present invention with high nonloaded-Q.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A multi-layer thin-film electrode comprising:

at least two thin conductor films and at least one thin dielectric film, each alternately being laminated with respect to each other on a dielectric substrate, an electro-magnetic field transmitted in said dielectric substrate and an electromagnetic field transmitted in said at least one thin dielectric film having substantially the same phase at a predetermined frequency;

wherein an adhesive conductor film is provided between said dielectric substrate and one of said at least two thin conductor films adjacent thereto and between each other of said at least two thin conductor films and said at least one thin dielectric film adjacent thereto, respectively, the adhesive conductor film forming metallic oxide more readily than said at least two thin conductive films; and wherein an increase in surface reactance of each said at least two thin conductor films caused by the formation of each said adhesive conductor film adjacent thereto is substantially canceled by correcting the thickness of said at least one thin dielectric film based on the dielectric constants of said at least one thin dielectric film and said dielectric substrate and the thickness of said adhesive conductor film.

2. The multi-layer thin-film electrode of claim 1, wherein said adhesive conductor film consists of at least one metal selected from the group comprising Zr, Hf, Ti, Ta, Nb, V, and Cr.

3. The multi-layer thin-film electrode of claim 2, wherein the thickness of said at least one thin dielectric film is corrected based on the following equation:

$$\text{thickness correction } \Delta xs=\{(\in_m/\in_s)-1\}^{-1}\cdot\Delta s$$

wherein $\in_m$ is the dielectric constant of said dielectric substrate, $\in_s$ is the dielectric constant of each of said thin dielectric films, and $\Delta s$ is the thickness of said adhesive conductor film.

4. A high-frequency transmission line comprising:

a dielectric substrate;

a first electrode disposed on substantially an entire main surface of said dielectric substrate;

a second electrode disposed on an opposite surface of the substrate; and wherein one of said first and second electrodes is a multi-layer thin film electrode having:

at least two thin conductor films and at least one thin dielectric film, each alternately being laminated with respect to each other on the dielectric substrate, an electro-magnetic field transmitted in said dielectric substrate and an electromagnetic field transmitted in said at least one thin dielectric film having substantially the same phase at a predetermined frequency; wherein an adhesive conductor film is provided between said dielectric substrate and one of said at least two thin conductor films adjacent thereto and between each other of said at least two thin conductor films and said at least one thin dielectric film adjacent thereto, respectively, the adhesive conductor film forming metallic oxide more readily than said at least two thin conductive films; and an increase in surface reactance of said at least two thin conductor films caused by the formation of each said adhesive conductor film adjacent thereto is substantially canceled by correcting the thickness of said at least one thin dielectric film based on the dielectric constants of said at least one thin dielectric film and said dielectric substrate and the thickness of said adhesive conductor film.

5. A high-frequency transmission line comprising:

a dielectric substrate;

a first electrode disposed on substantially an entire main surface of said dielectric substrate;

a second electrode disposed on substantially an entire opposite surface of the dielectric substrate;

a third electrode embedded in the dielectric substrate; and wherein at least one of said first and second electrodes is a multi-layer thin film electrode having:

at least two thin conductor films and at least one thin dielectric film, each alternately being laminated with respect to each other on the dielectric substrate, an electro-magnetic field transmitted in said dielectric substrate and an electromagnetic field transmitted in said at least one thin dielectric film having substantially the same phase at a predetermined frequency; wherein an adhesive conductor film is provided between said dielectric substrate and one of said at least two thin conductor films adjacent thereto and between each other of said at least two thin conductor films and said at least one thin dielectric film adjacent thereto, respectively, the adhesive conductor film forming metallic oxide more readily than said at least two thin conductive films; and an increase in surface reactance of said at least two thin conductor films caused by the formation of each said adhesive conductor film adjacent thereto is substantially canceled by correcting the thickness of said at least one thin dielectric film based on the dielectric constants of said at least one thin dielectric film and said dielectric substrate and the thickness of said adhesive conductor film.

6. A high-frequency coaxial transmission line comprising:

a dielectric substrate;

an inner electrode embedded in the substrate;

an outer electrode disposed on an outer surface of the dielectric substrate to surround the inner electrode; wherein at least one of said inner and outer electrodes comprises:

at least two thin conductor films and at least one thin dielectric film, each alternately being laminated with respect to each other on or in the dielectric substrate, an electro-magnetic field transmitted in said dielectric substrate and an electromagnetic field transmitted in said at least one thin dielectric film having substantially the same phase at a predetermined frequency; wherein an adhesive conductor film is provided between said dielectric substrate and one of said at least two thin conductor films adjacent thereto and between each other of said at least two thin conductor films and said at least one thin dielectric film adjacent thereto, respectively, the adhesive conductor film forming metallic oxide more readily than said at least two thin conductive films; and an increase in surface reactance of each said at least two thin conductor films caused by the formation of said adhesive conductor film adjacent thereto is substantially canceled by correcting the thickness of said at least one thin dielectric film based on the dielectric constants of said at least one thin dielectric film and said dielectric substrate and the thickness of said adhesive conductor film.

7. A high-frequency resonator comprising:

a dielectric substrate;

a first electrode disposed on one surface of the substrate;

a second electrode disposed on an opposite surface of the substrate; wherein at least one of said first and second electrode comprises:

at least two thin conductor films and at least one thin dielectric film, each alternately being laminated with respect to each other on the dielectric substrate, an electro-magnetic field transmitted in said dielectric substrate and an electromagnetic field transmitted in said at least one thin dielectric film having substantially the same phase at a predetermined frequency; wherein an adhesive conductor film is provided between said dielectric substrate and one of said at least two thin conductor films adjacent thereto and between each other of said at least two thin conductor films and said thin dielectric film adjacent thereto, respectively, the adhesive conductor film forming metallic oxide more readily than said at least two thin conductive films; and an increase in surface reactance of each said at least two thin conductor films caused by the formation of said adhesive conductor film adjacent thereto is substantially canceled by correcting the thickness of said at least one thin dielectric film based on the dielectric constants of said at least one thin dielectric film and said dielectric substrate and the thickness of said adhesive conductor film.

8. A high-frequency dielectric filter comprising:

a dielectric substrate;

a first electrode disposed on one surface of the substrate;

a second electrode disposed on an opposite surface of the substrate, said first and second electrode and dielectric substrate therebetween forming a dielectric resonator;

an input electrode disposed on a surface of the substrate to electromagnetically couple with said resonator;

an output electrode disposed on a surface of the substrate to electromagnetically couple with said resonator; wherein at least one of said first, second, input and electrodes comprises:

at least two thin conductor films and at least one thin dielectric film, each alternately being laminated with respect to each other on the dielectric substrate, an electro-magnetic field transmitted in said dielectric substrate and an electromagnetic field transmitted in said at least one thin dielectric film having substantially the same phase at a predetermined frequency; wherein an adhesive conductor film is provided between said dielectric substrate and one of said at least two thin conductor films adjacent thereto and between each other of said at least two thin conductor films and said thin dielectric film adjacent thereto, respectively, the adhesive conductor film forming metallic oxide more readily than said at least two thin conductive films; and an increase in surface reactance of each said at least two thin conductor films caused by the formation of said adhesive conductor film adjacent thereto is substantially canceled by correcting the thickness of said at least one thin dielectric film based on the dielectric constants of said at least one thin dielectric film and said dielectric substrate and the thickness of said adhesive conductor film.

9. A method of making a multi-layer thin film electrode comprising the steps of:

providing at least two thin conductor films and at least one thin dielectric film, alternately laminated on a dielectric substrate with respect to each other, wherein an electromagnetic field transmitted in said dielectric substrate and an electromagnetic field transmitted in said at least one thin dielectric film have substantially the same phase at a predetermined frequency;

providing an adhesive conductor film between said dielectric substrate and one of said at least two thin conductor films adjacent thereto and between each other of said at least two thin conductor films and said at least one thin dielectric film adjacent thereto, respectively, the adhesive conductor film forming metallic oxide more readily than said at least two thin conductive films; and causing a substantial cancellation of an increase in surface reactance of each of said at least two thin conductor films caused by the formation of each said adhesive conductor film adjacent thereto by correcting the thickness of said at least one thin dielectric film based on the dielectric constants of said at least one thin dielectric film and said dielectric substrate and the thickness of said adhesive conductor film.

10. The method of claim 9, further comprising the step of selecting said adhesive conductor film from at least one metal selected from the group consisting of Zr, Hf, Ti, Ta, Nb, V, and Cr.

11. The method of claim 10, further wherein the step of correcting comprises determining a thickness correction ΔxS and adjusting the thickness of said at least one thin dielectric film by said amount ΔxS, said thickness correction ΔxS being calculated as follow:

$$\text{thickness correction } \Delta xS=\{(\in_m/\in_s)-1\}^{-}\cdot\Delta s$$

wherein $\in_m$ is the dielectric constant of said dielectric substrate, $\in_s$ is the dielectric constant of each of said thin dielectric films, and Δs is the thickness of said adhesive conductor film.

12. A method for setting the thickness of each thin dielectric film and each thin conductor film of a multi-layer thin film electrode, wherein the electrode has:

at least two thin conductor films and at least one thin dielectric film, each alternately laminated with respect to each other on a dielectric substrate, wherein an electro-magnetic field transmitted in said dielectric substrate and an electromagnetic field transmitted in said at least one thin dielectric film have substantially the same phase at a predetermined frequency; and an adhesive conductor film between said dielectric substrate and one of said at least two thin conductor films adjacent thereto and between each other of said at least two thin conductor films and said at least one thin dielectric film adjacent thereto, respectively, the adhesive conductor film forming metallic oxide more readily than said at least two thin conductive films; the method comprising the step of:

correcting the thickness of each said thin dielectric film based on the dielectric constants of said at least one thin dielectric film and said dielectric substrate and the thickness of said adhesive conductor film, thereby causing a substantial cancellation of an increase in surface reactance of each of said at least two thin conductor films caused by the formation of each said adhesive conductor film adjacent thereto.

13. The method of claim 12, further comprising the step of selecting said adhesive conductor film from at least one metal selected from the group consisting of Zr, Hf, Ti, Ta, Nb, V, and Cr.

14. The method of claim 13, further wherein the step of correcting comprises determining a thickness correction ΔxS and adjusting the thickness of said at least one thin dielectric film by said amount ΔxS, said thickness correction ΔxS being calculated as follow:

$$\text{thickness correction } \Delta xs=\{(\in_m/\in_s)-1\}^{-1}\cdot\Delta s$$

wherein $\in_m$ is the dielectric constant of said dielectric substrate, $\in_s$ is the dielectric constant of each of said thin dielectric films, and Δs is the thickness of said adhesive conductor film.

* * * * *